United States Patent [19]

Zijsling

[11] Patent Number: 4,926,950

[45] Date of Patent: May 22, 1990

[54] METHOD FOR MONITORING THE WEAR OF A ROTARY TYPE DRILL BIT

[75] Inventor: Djurre H. Zijsling, Rijswijk, Netherlands

[73] Assignee: Shell Oil Company, Houston, Tex.

[21] Appl. No.: 287,640

[22] Filed: Dec. 20, 1988

Related U.S. Application Data

[62] Division of Ser. No. 26,609, Mar. 17, 1987.

[30] Foreign Application Priority Data

Mar. 27, 1986 [GB] United Kingdom ..... 8607700

[51] Int. Cl.[5] ..... E21B 3/00; E21B 12/02

[52] U.S. Cl. ..... 175/39; 175/329

[58] Field of Search ..... 175/39, 410, 329, 330, 175/379; 73/151

[56] References Cited

U.S. PATENT DOCUMENTS

| | | | |
|---|---|---|---|
| 4,098,362 | 7/1978 | Bonnice | 175/329 |
| 4,109,737 | 8/1978 | Bovenkerk | 175/329 |
| 4,194,790 | 3/1980 | Kenny et al. | 299/79 |
| 4,244,432 | 1/1981 | Rowley et al. | 175/329 |
| 4,259,090 | 3/1981 | Bovenkerk | 51/309 |
| 4,373,593 | 2/1983 | Phaal et al. | 175/329 |
| 4,498,549 | 2/1985 | Jurgens | 175/329 |
| 4,554,986 | 11/1985 | Jones | 175/329 X |
| 4,558,753 | 12/1985 | Barr | 175/329 |
| 4,624,830 | 11/1986 | Barr | 175/329 X |
| 4,646,857 | 3/1987 | Thompson | 175/329 |
| 4,685,329 | 8/1987 | Burgess | 175/39 X |
| 4,695,957 | 9/1987 | Peltier | 73/151 X |

FOREIGN PATENT DOCUMENTS

| | | | |
|---|---|---|---|
| 0119620 | 9/1984 | European Pat. Off. . | |
| 154936 | 9/1985 | European Pat. Off. | 175/329 |
| 0155026 | 9/1985 | European Pat. Off. . | |
| 2355990 | 1/1978 | France . | |
| 641059 | 1/1979 | U.S.S.R. | 175/410 |
| 2152104 | 7/1985 | United Kingdom | 175/329 |

OTHER PUBLICATIONS

MEGAdiamond, Oct. 6, 1981.

*Primary Examiner*—Hoang C. Dang

[57] ABSTRACT

A rotary drill bit is provided with cutting elements having a front layer of interbonded abrasive particles, such as synthetic diamonds, which layer has a thickness that varies with distance from the bit body. The characteristic relation thus obtained between bit agressiveness and bit wear can be used to monitor the bit wear condition during drilling.

2 Claims, 2 Drawing Sheets

METHOD FOR MONITORING THE WEAR OF A ROTARY TYPE DRILL BIT

This is a division of application Ser. No. 026,609 filed Mar. 17, 1987.

BACKGROUND OF THE INVENTION

The invention relates to a rotary drill bit for deephole drilling in subsurface earth formations, and in particular to a drill bit including a bit body which is suitable to be coupled to the lower end of a drill string and carries a plurality of cutting elements.

Bits of this type are known and disclosed, for example, in U.S. Pat. Nos. 4,098,362 and 4,244,432. The cutting elements of the bits disclosed in these patents are preformed cutters in the form of cylinders that are secured to the bit body either by mounting the elements in recesses in the body or by brazing or soldering each element to a pin which is fitted into a recess in the bit body. Impacts exerted to the cutting elements during drilling are severe and in order to avoid undue stresses in the elements, the frontal surface of each element is generally oriented at a negative top rake angle between zero and twenty degrees.

The cutting elements usually comprise a front layer consisting of synthetic diamonds or cubic boron nitride particles that are bonded together to a compact polycrystalline mass. The front layer of each cutting element may be backed by a cemented tungsten carbide substratum to take the thrust imposed on the front layer during drilling. Preformed cutting elements of this type are disclosed in U.S. Pat. No. 4,194,790 and in European Patent No. 0029187 and they are often indicated as composite compact cutters, or—in case the abrasive particles are diamonds—as polycrystalline diamond compacts (PDC's).

A general problem encountered with conventional drill bits of the above type is that the degree of bit wear cannot be monitored in an accurate manner. Hence, it may sometimes happen that a hardly worn bit is retrieved to the surface for replacement. Furthermore, it may happen that during drilling in particular formations excessive bit wear takes place while during drilling in other formations hardly any bit wear takes place. Thus, there is a need to enable operating personnel to select optimum operating conditions for particular formations in order to avoid excessive wear rates and to determine an optimum combination between performance and lifetime of rotary drill bits.

SUMMARY OF THE INVENTION

Therefore, it is an object of the invention to provide a drill bit of which the degree of bit wear can be monitored continuously and accurately during drilling.

In accordance with the invention this object is accomplished by a drill bit comprising a bit body and cutting elements protruding from the body wherein at least some of said elements comprise a front layer of interbonded abrasive particles having a thickness which varies with distance from the body.

In a suitable embodiment of the invention the thickness of the front layer gradually decreases with distance from the bit body.

A further object of the invention is to provide a cutting element for use in the bit.

The cutting element according to the invention thereto comprises a front layer of interbonded abrasive particles, which layer has a varying thickness.

BRIEF DESCRIPTION OF THE DRAWINGS

The invention will now be explained in more detail by way of example with reference to the accompanying drawing, in which.

DETAILED DESCRIPTION OF THE PREFERRED EMBODIMENTS

Figure 1:
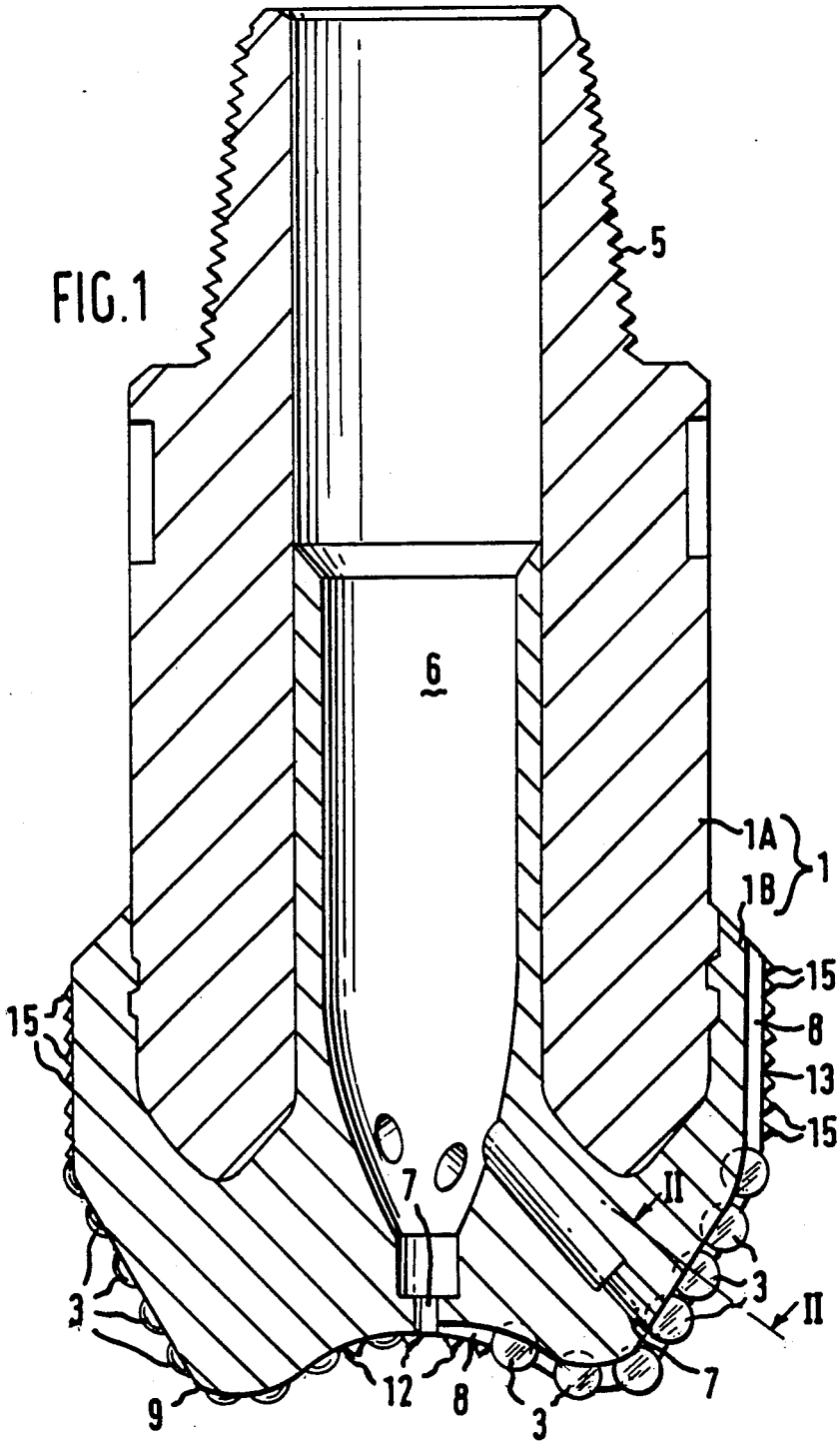
FIG. 1 is a vertical section of a rotary drill bit embodying the invention.

The rotary drill bit shown in FIG. 1 comprises a bit body 1 consisting of a steel shank 1A and a hard metal matrix 1B in which a plurality of preformed cylindrical cutting elements 3 are inserted.

The shank 1A is at the upper end thereof provided with a screw thread coupling 5 for coupling the bit to the lower end of a drill string (not shown). The bit body 1 comprises a central bore 6 for allowing drilling mud to flow from the interior of the drill string via a series of nozzles 7 into radial flow channels 8 that are formed in the bit face 9 in front of the cutting elements 3 to allow the mud to cool the elements 3 and to flush drill cuttings upwards into the surrounding annulus.

The cutting elements 3 are arranged in radial arrays such that the frontal surfaces 10 (see FIG. 2) thereof are flush to one of the side walls of the flow channels 8. The radial arrays of cutting elements are angularly spaced about the bit face 9 and in each array the cutting elements 3 are arranged in a staggered overlapping arrangement with respect of the elements 3 in adjacent arrays so that the concentric grooves that are carved during drilling by the various cutting elements 3 into the borehole bottom effectuate a uniform deepening of the hole.

The bit comprises, besides the cylindrical cutting elements 3, a series of surface set massive diamond cutters 12, which are embedded in the portion of the matrix 1B near the center of rotation of the bit. At the gauge 13 of the bit a series of massive diamond reaming elements 15 are inserted in the matrix IB which are intended to cut out the borehole at the proper diameter and to stabilize the bit in the borehole during drilling.

Figure 2:
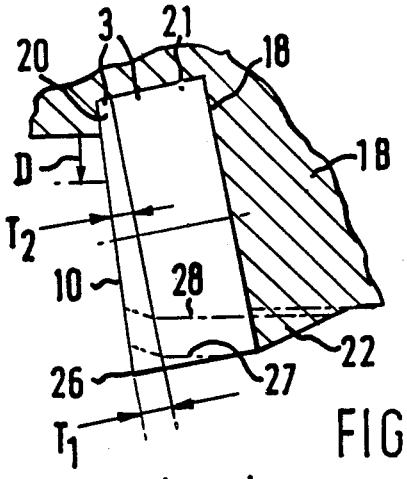
FIG. 2 shows one of the cutting elements of the bit of FIG. 1, taken in cross section along line II—II of FIG. 1.
Figure 3:
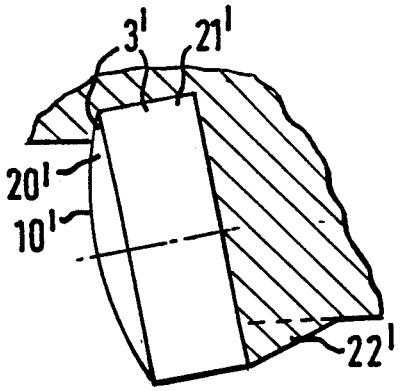
FIG. 3 shows an alternative configuration of a cutting element according to the invention.
Figure 4:
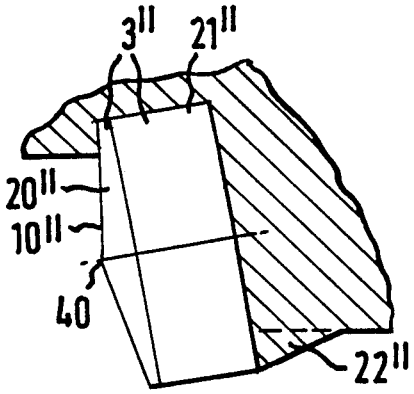
FIG. 4 shows another alternative configuration of a cutting element according to the invention.

As illustrated in FIGS. 2–4, each cylindrical cutting element 3 is fitted by brazing or soldering into a preformed recess 18 in the matrix 1B. The cylindrical cutting element 3, 3', 3'' shown in these figures consists of a front layer 20, 20 , 20'' consisting of a polycrystalline mass of abrasive particles, such as synthetic diamonds or cubic boron nitride particles, and a tungsten carbide substratum 21, 21', 21''. The cutting element 3, 3', 3'' is backed by a support fin 22, 22' 22'' protruding from the bit matrix 1B to take the thrust imposed on the element during drilling.

In FIG. 2 there is shown a cutting element 3 provided with an abrasive front layer 20 having a thickness T which gradually increases with the distance D from the bit body 1B. Hence, at the toe 26 of the element 3 the thickness $T_1$ of the abrasive front layer 20 is larger than the thickness $T_2$ thereof at points above the toe 26.

As illustrated by the dash-dot lines 27 and 28 the substratum 21 wears off during drilling in such a manner that the lower surface thereof is oriented parallel to the hole bottom (not shown), whereas the abrasive front layer wears off such that the toe thereof is oriented at a sharp angle relative to the hole bottom. Details of the wear pattern of a cutting element during drilling are described in applicant's European patent application No. 85200184.1 (publication No. 0155026; publication date: 18th Sept., 1985). As described in this prior art reference the angle between the toe of the cutting element remains substantially constant during drilling, irrespective of the thickness T of the abrasive front layer 20, weight on bit applied, and the velocity of the cutting element relative to the hole bottom. Due to the constant wear angle the magnitude of the so called build-up edge of crushed rock, the inherent friction between the toe of the cutting element, the hole bottom and the chip being removed therefrom, are dependent on the thickness T of the front layer 20.

Due to the configuration of the element 3 of FIG. 2, the magnitude of the build-up edge decreases as bit wear progresses (see the dash-dot lines 27 and 28). Consequently, the magnitude of the cutting force and the inherent bit aggressiveness (defined as the ratio between bit torque and weight on bit) will also decrease with progressing bit wear.

The characteristic relation between bit wear and bit aggressiveness in the bit according to the invention can be used to monitor during drilling the bit wear condition by measuring the torque on bit and weight on bit during drilling. Said measurements can be taken either at the surface or downhole whereupon the measured signal is transmitted to surface by measuring while drilling techniques.

Monitoring bit wear during drilling provides, besides the determination of the moment at which a worn bit is to be replaced, the opportunity to select optimum operating conditions for particular formations in order to avoid excessive wear rates and to determine an optimum combination between performance and lifetime of the bit.

FIGS. 3 and 4 show alternative configurations of a cutting element embodying the invention. In the configuration shown in FIG. 3 the abrasive front layer 20' of the cylindrical element 3' has a convex frontal surface 10', wherein in the configuration shown in FIG. 4 the frontal surface 10'' of the abrasive front layer 20'' has a frusto-conical shape.

In configurations shown in FIGS. 3 and 4, the magnitude of the build-up edge formed during drilling at the toe of the element will first increase and subsequently decrease as bit wear progresses. Hence, bit aggressiveness will first increase and subsequently decrease with progressing bit wear. The convex configuration of the front layer 20' of the element 3' shown in FIG. 3 will initiate a gradual variation of bit agressiveness during drilling, whereas the conical configuration of the front layer 20'' of the element 3'' shown in FIG. 4 will initiate a more abrupt change from increasing to decreasing bit agressiveness as the cutting element has been worn away to such an extent that the toe of the element 3'' is located at the center 40 of the frusto conical surface 11'' of the front layer 20''.

It will be understood that the configurations of the front layers shown in the drawing are examples only. Other configurations may be used as well provided that the cutting aggressiveness of the element varies throughout its lifetime.

In order to avoid that the varying cutting aggressiveness impairs the cutting process, it is preferred to vary the thickness of the abrasive front layer only within a selected range. A suitable thickness range is between 0.1 and 3 mm.

It is observed that instead of the cylindrical shape of the cutting elements shown in the drawing, the cutting elements of the bit according to the invention may have any other suitable shape, provided that the cutting elements are provided with an abrasive front layer having a varying thickness. It will be further appreciated that the cutting element may consist of a front layer only, which front layer is sintered directly to the hard metal bit body. Furthermore, it will be understood that instead of the particular distribution of the cutting elements along the bit face shown in FIG. 1 the cutting elements may be distributed in other patterns along the bit face as well.

What is claimed is:

1. A method of monitoring the wear of a rotary type drill bit for deephole drilling subsurface earth formations, comprising:

providing a plurality of cutting elements protruding from a bit body coupled to the lower end of the drill string wherein at least some of the cutting elements are provided with a front layer of interbonded abrasive particles having a thickness which varies substantially with distance from the bit body; and measuring the ratio of torque on bit to weight on bit during drilling as an indication of the thickness of the front layer of abrasive particles presented at the wearing edge of the cutting elements thereby providing an indication of the progress of bit wear.

2. A method of monitoring the wear of a drill bit in accordance with claim 1 wherein providing the plurality of cutting elements includes providing cutting elements having front layers which first increase and then decrease in thickness with distance from the bit body and wherein monitoring the ratio of torque on bit to weight on bit during drilling further comprises measuring an increase and subsequent decrease of this ratio as wear progresses past the thickest portion of the front layer.

* * * * *